US005106331A

United States Patent [19]

Lizarazu

[11] Patent Number: 5,106,331

[45] Date of Patent: Apr. 21, 1992

[54] APPARATUS FOR BODY SURFING AND METHOD OF MAKING THE SAME

[76] Inventor: Jairo Lizarazu, 2445 Porter St., Altadena, Calif. 91104

[21] Appl. No.: 539,375

[22] Filed: Jun. 18, 1990

Related U.S. Application Data

[63] Continuation-in-part of Ser. No. 358,170, May 26, 1989, abandoned.

[51] Int. Cl.[5] ..... A63C 15/02

[52] U.S. Cl. ..... 441/55; 441/74; 2/2; 2/2.1 R

[58] Field of Search ..... 441/55, 65-67, 441/74, 75, 79, 106, 129; 2/2.1 R, 2, 2.5, 46, 67, 69; 272/1 B, 71

[56] References Cited

U.S. PATENT DOCUMENTS

| | | | |
|---|---|---|---|
| 1,099,575 | 6/1914 | Skaszynski | 441/65 |
| 1,552,603 | 9/1925 | Hawks | 441/65 |
| 1,843,617 | 2/1932 | Marshall | 441/55 |
| 3,803,652 | 4/1974 | Uyehara | 441/66 |
| 4,397,636 | 8/1983 | Ganshaw | 441/65 |
| 4,820,221 | 4/1989 | Aubrey | 441/106 |
| 4,833,729 | 5/1989 | Fox | 2/2.1 R |

*Primary Examiner*—Joseph F. Peters, Jr.
*Assistant Examiner*—Clifford T. Bartz

[57] ABSTRACT

An apparatus for body surfing and method of making the same are disclosed. The apparatus comprises a garment for covering at least a portion of the torso of the user during use and a rigid outer shell securely attached to a torso portion of an outer surface of the garment. The outer shell is located adjacent the torso of the user during use thereof for providing hydro-dynamic lift for the user while traveling with the forward motion of a wave. The apparatus preferably includes an inner unit locatable adjacent an inner surface of the garment. The inner unit is located between the garment and at least a portion of the user's torso during use. The inner unit provides increased protection for the user and added lift during use.

31 Claims, 2 Drawing Sheets

APPARATUS FOR BODY SURFING AND METHOD OF MAKING THE SAME

This is a continuation-in-part of copending application Ser. No. 07/358,170 filed on May 26, 1989, now abandoned.

BACKGROUND OF THE INVENTION

1. Field of the Invention

This invention relates to body surfing and, more particularly, to an apparatus that can be worn by the user which provides increased hydro-dynamic lift for the user while traveling with the forward motion of a wave, and a method of making the same.

2. Description of the Related Art

For countless people who love water sports, one of the most pleasing activities is the riding of waves. Many diversified ways of surfing are used by surf enthusiasts. These ways include mere body surfing, without the use of any apparatus, and may extend to the use of some very high tech, hydro-propulsion devices.

U.S. Pat. No. 4,214,547, issued to P. R. Hetland, entitled "Rider Propelled Boat" discloses a boat formed of lightweight material that permits the rider to stand on the boat much like a surfboard. Rolling the boat about its longitudinal axis causes provided fins to flex and form propulsion apparatus for the boat.

U.S. Pat. No. 3,514,798, issued to R. Ellis, entitled "Surf-Board Construction and Method of Making Same" discloses a surfboard comprising a relatively thin outer shell and a core within the shell. The core comprises a longitudinally disposed panel of honeycomb construction, the core being secured to the inside surface of the outer shell. The honeycomb panel is divided, one part of the panel being attached to the underside of the top part of the surfboard shell and the other part of the panel being attached to the bottom side of the surfboard to form a longitudinal cavity in the interior of the shell between the parts of the panel when they are secured together.

U.S. Pat. No. 3,626,428, issued to C. Collaro, entitled "Surf Boards" discloses a surfboard having hull with sufficient buoyancy to support a rider. The surfboard has a seat which is pivotally mounted so that it can turn about an upright axis and a rudder which is connected to the seat so that the rider can steer the surfboard by twisting the seat.

U.S. Pat. No. 3,416,171, issued to G. B. L. Hennebutte, entitled "Surf-boat with Air-Floats", discloses a surf-boat comprising a rigid hull with concave sides and elongated air-floats fixed along the sides, blocks, each having a profiled under face fixed on the top of each float and a hollowed-out top face forming a recess, at least one surf board being placed flatwise within the recess and a detachable elastic tie which serves to hold the surf-board in position.

Typically, more serious surfing enthusiasts utilize commercially available surfboards while less serious surfers use commercially available boogy boards. Use of a surfboard requires extensive practice. Both the use of a surfboard and a boogy board require transportation of rather bulky apparatus.

SUMMARY OF THE INVENTION

An apparatus for body surfing and method of making the same are disclosed. The apparatus, in its broadest aspects, comprises a garment for covering at least a portion of the torso of the user during use; and, a rigid outer shell securely attached to a torso portion of an outer surface of the garment. The outer shell is located adjacent the torso of the user during use thereof for providing hydro-dynamic lift for the user while traveling with the forward motion of a wave.

In its narrower aspects, the apparatus further includes an inner unit locatable adjacent an inner surface of the garment. The inner unit is located between the garment and at least a portion of the user's torso during use, the inner unit providing increased protection for the user and added lift during use. The inner unit is preferably removable for allowing added flexibility in use.

Use of the present invention allows heretofore unrealized maneuverability while surfing and concomitant safety. Furthermore, the apparatus is much more compact than either surfboards or boogy boards and is therefore more convenient to transport to the beach.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figure 1:
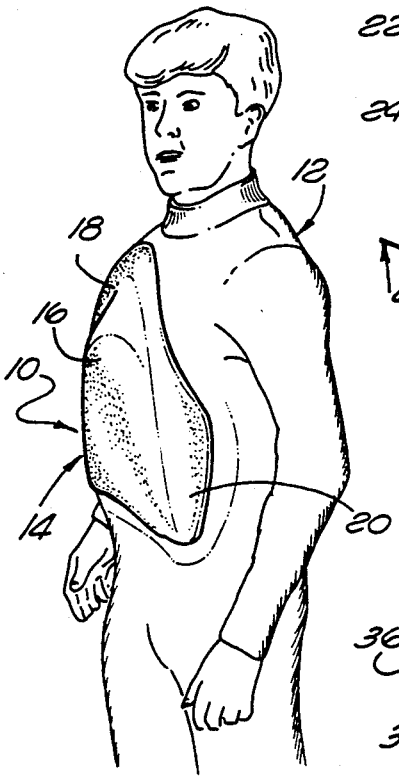
FIG. 1 is a perspective illustration of a user wearing a first embodiment of the apparatus of the present invention.

Referring to the drawings and the characters of reference marked thereon, FIG. 1 illustrates a first embodiment of the apparatus of the present invention designated generally as 10, and placed upon a user. The apparatus 10 includes a garment 12, preferably formed of neoprene, as in commercially available wetsuits. A substantially smooth, rigid outer shell, designated generally as 14, is securely attached to a torso portion of the garment 12. The outer shell 14 is preferably a unitary structure with a substantially smooth central portion 16 and a flared edge portion having a leading section 18 and two side sections 20. Utilization of such a shaped outer shell 14 provides substantial conformity to a user's rib cage. Furthermore, the compound, dual surface, provides superior hydro-dynamic characteristics, for facilitating the passage of the user over the water. It provides a hydroplane effect, thereby increasing the user's speed and performance through the wave. In this embodiment, the outer shell is formed of a plastic such as styrene or polyethylene, preferably a high density, high impact polyethylene. One possible polyethylene may be the copolymer ethylene methyl acrylate. The rigid outer shell may be made with a thickness of approximately 1/16". The outer shell 14 may be securely attached to the wetsuit 12 by suitable adhesive means such as epoxy resin.

Figure 2:
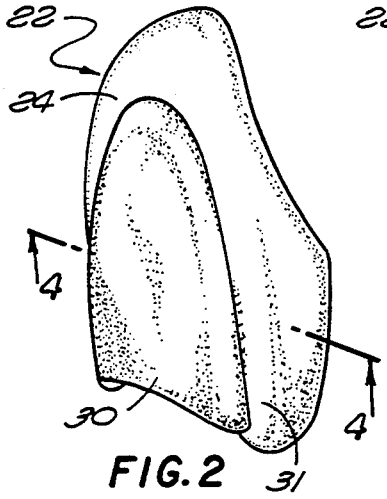
FIG. 2 is a front perspective view of the inner unit utilized as part of the present invention.
Figure 3:
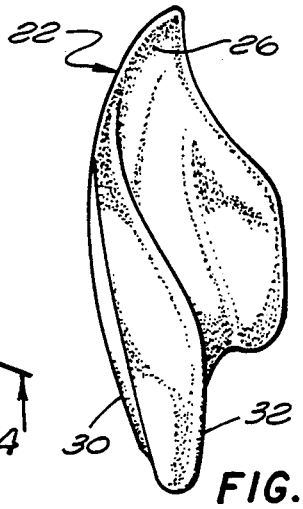
FIG. 3 is a rear perspective view of the inner unit illustrated in FIG. 2.

Referring now to FIG. 2, the apparatus 10 preferably also includes an inner unit, designated generally as 22. The inner unit 22 is located adjacent an inner surface of the wetsuit 12 during use. The inner unit 22 has an anterior surface 24 which is shaped so as to be in complementary relationship with the outer shell 14. As is shown in FIG. 3, the posterior surface 26 of the inner unit 22 is preferably contoured to substantially conform to a user's rib cage. The inner unit is preferably removable and provides increased protection for the user and added lift during use.

Figure 4:
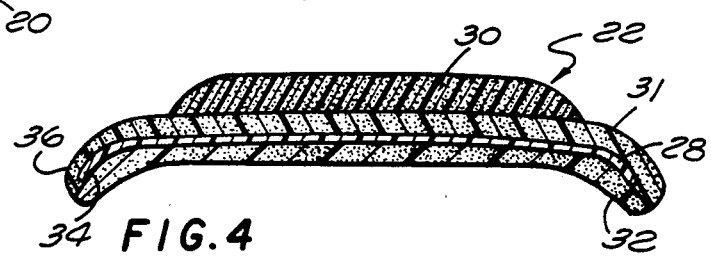
FIG. 4 is a cross-sectional view of the inner unit shown along line 4—4 of FIG. 2.

Referring now to FIG. 4, a cross-sectional view of the inner unit 22 is illustrated. The inner unit 22 preferably includes a rigid inner element 28 and a somewhat flexible porous outer jacket including an anterior section 30, 31 and a posterior section 32. The rigid inner element 28 is preferably formed of epoxy resin which is approximately 1/16" thick. The anterior section includes an anterior portion 30 securely sealed to a posterior portion 31, each being preferably formed of high density closed cell neoprene. The posterior section 32 is preferably formed of low density closed cell neoprene. Utilizing low density closed cell neoprene on the posterior section 32 provides safer use and commensurate greater comfort for the user while surfing. Use of the epoxy resin inner element 28 provides the required rigidity for use in a pounding surf. However, the rigid inner element 28 is surrounded by the outer jacket 30, 31, 32 for safety and added buoyancy. In this regard, it is noted that the outer periphery 34 of the inner element 28 is located approximately ½" from the outer surface 36 of the inner unit 22. Thus, in the event of a dramatic shock to the inner unit 22 the inner unit will bend but the rigid inner element 28 will not be able to puncture the body of the user. The elements 28, 30, 31 and 32 are preferably bonded together by epoxy resin.

Figure 5:
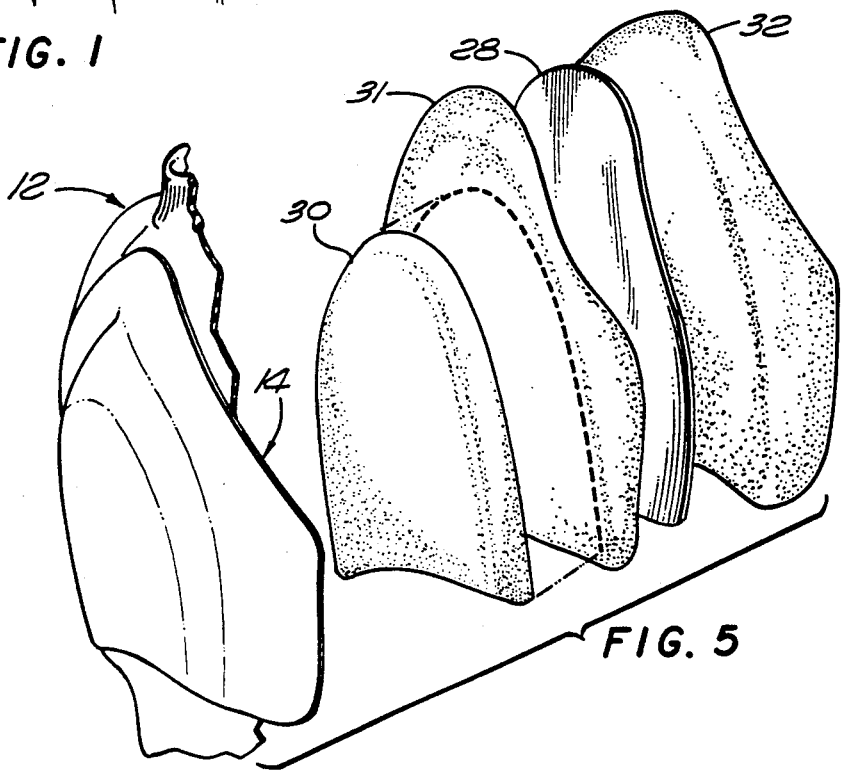
FIG. 5 is an exploded perspective view of the apparatus of the present invention.

Referring now to FIG. 5, an exploded perspective of the apparatus 10 is illustrated. As can be seen, the outer shell 14 is securely attached to the wetsuit 12. The sections 30, 31, 32 and element 28 are shown in their relative configuration with respect to the wetsuit 12.

As noted, the inner unit 22 is preferably removable, allowing greater flexibility in use. Generally, less skilled users would desire to keep the inner unit in place for increased buoyancy and safety. As they become more skilled, it may be desirable to surf without the inner unit 22. This allows greater speed and flexibility in freestyle maneuvers. However, it is within the purview of this invention that such an inner unit 22 be integrally attached to the wetsuit 12. Such an integral attachment would eliminate any possibility of slippage of parts.

It is also noted that the garment 12 described is a neoprene wetsuit. Neoprene provides comfort for the user and a convenient mechanism for attachment of outer shell 14. It has excellent memory and resilient properties. However, other suitable materials may be utilized. Furthermore, although the wetsuit 12 is illustrated as being full bodied, it is understood that the only requirement is that there be a means provided for attaching the outer shell 14 to the body of the user. Thus, the wetsuit might be of the type that only fits around the upper torso of the user. The outer shell 14 should be of sufficient size to provide lift during use.

In operation, the user inserts the inner unit 22 in its proper location within the wetsuit 12. He then dons the wetsuit while holding the inner unit 22 in this correct position. The zipper in the back is secured and the user is ready to body surf. The present invention is easier to utilize than either a surfboard or a boogy board. In either of those cases, the user must maintain a grip on the device. With the present invention, the user is free to do all kinds of freestyle maneuvers, both on top of the water and under the water. Furthermore, these maneuvers can be attempted with a minimized safety risk. The smooth surface of the outer shell 14 reduces drag on the water. The side sections 20 facilitate side movements.

Figure 6:
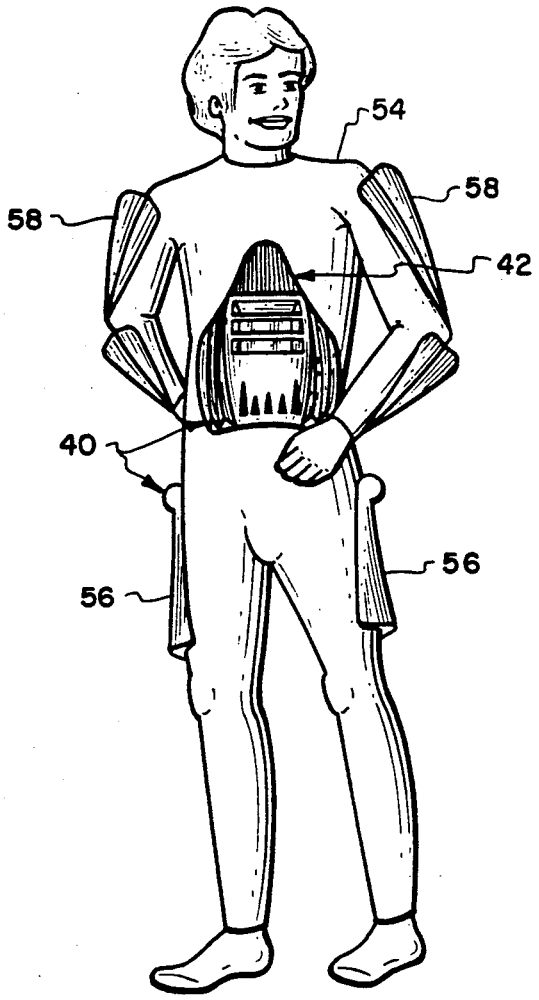
FIG. 6 is a perspective illustration of a user wearing a second embodiment of the apparatus of the present invention.
Figure 8:
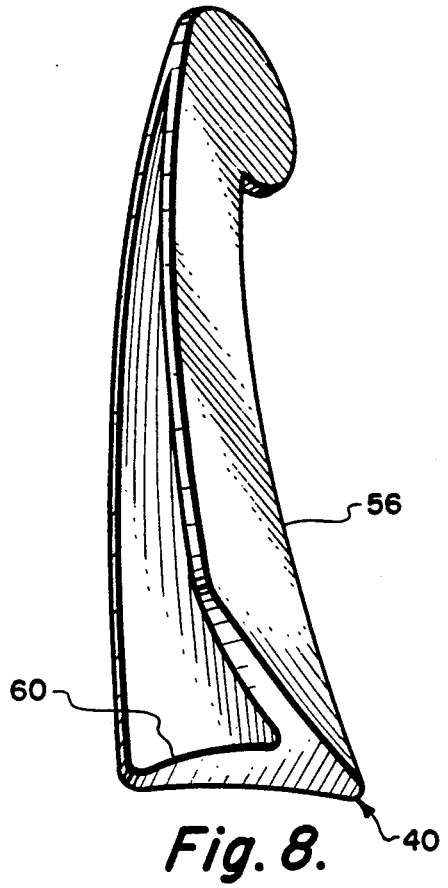
FIG. 8 is a side perspective view of the leg fin illustrated in FIG. 6.
Figure 7:
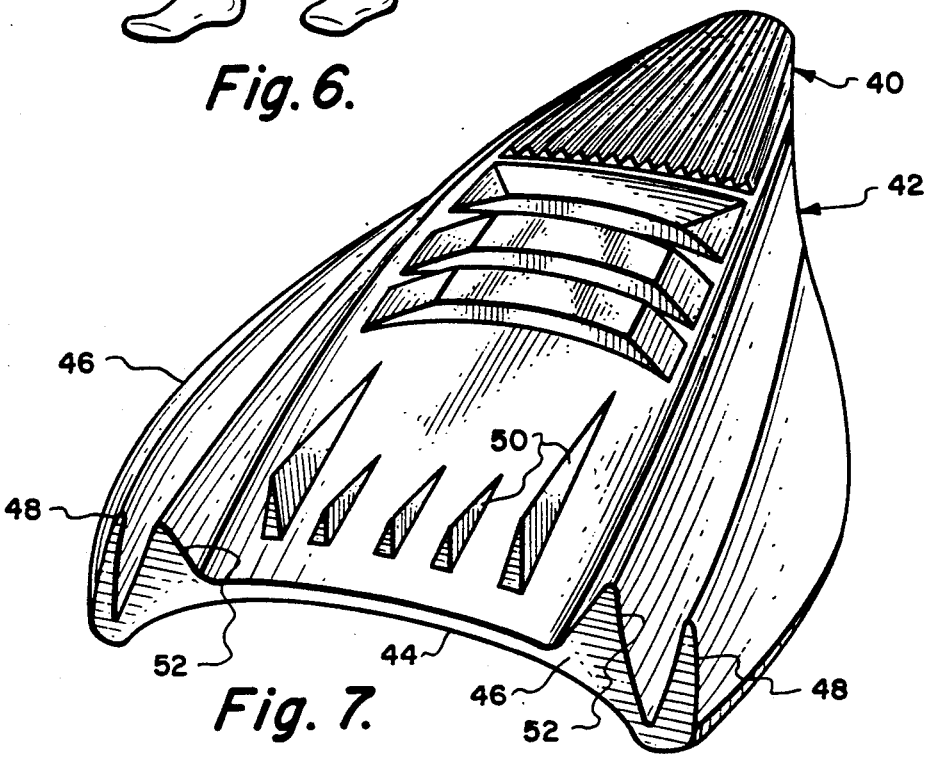
FIG. 7 is a front perspective view of the outer shell of the embodiment illustrated in FIG. 6.

Referring now to FIGS. 6–8, a second embodiment of the present invention is illustrated, designated generally as 40. In this embodiment, an outer shell is provided with increased thickness over the previous embodiment. A shield portion 42 of the outer shell has a central section 44 and flared lateral sections 46. As in the previous embodiment, the symmetric lateral sections 46 conform with the natural curvature of the user's torso. Each lateral section 46 includes a longitudinally disposed fin 48 for directional control and stabilization. Each fin 48 projects outwardly at an angle to an adjacent lateral portion of the user's upper torso.

The outer shell is preferably semi-flexible to conform to the shape of the wearer's torso. It may be formed of a self-skinning closed cell polyurethane foam, the fins preferably being formed as an integral part of this structure. A two component polyurethane 45 Shore A elastomer, such as that marketed as CU-20 by the Burtin Corp., Santa Ana, Calif., may be used. The relatively low shore hardness of this material provides a soft feel. Nevertheless good abrasion resistance is provided. The outer shell is contoured to allow the wearer to "plane up" on the wave, keeping his head out of the water.

To further enhance controllability, additional fins 50 may be utilized on shield 42, as illustrated, additionally, the extensions 52 of the outer surface of the shield 42, which form a part of the lateral sections 46, function as fins. The central section 44 is preferably around ¼ inches thick. At this thickness, there is some flexibility in the polyurethane structure, although it is substantially rigid.

The outer shell is sized sufficiently small and centered in the mid-torso area, as illustrated in FIG. 6, to allow the user to bend his head and waist freely, even to a crouched position. The outer shell is bonded to the wetsuit, preferably by a laminate such as polyurethane foam or an adhesive. Bonding the outer shell to the wetsuit rather than affixing it by some other method is advantageous because water is thereby prevented from occupying the region between the wetsuit and the outer shell. This minimizes drag and eliminates any "shovel" effect wherein the user is pulled down under the water.

The embodiment illustrated in FIG. 6 includes skegs or fins 56,58, securely attached to the wetsuit 54. These skegs 56,58 may be attached to the shoulders and/or legs, as illustrated, for enhanced control and maneuverability. An enlarged view of a leg skeg 56 is shown in FIG. 8. It includes an aft surface 60 which is contoured to approximate the shape of the user's thigh. Fins 56,58 are preferably formed of closed cell polyurethane foam. Similarly, they are preferably attached to the neoprene wetsuit by a polyurethane foam or adhesive.

Although FIG. 6 shows the user with fins on the legs and shoulders it is understood that various combinations of fin arrangements may be provided, including application of the fins to the outer shell described in the FIG. 1 embodiment. Furthermore, there are various ways in which the fins may be attached to the wetsuit, for example, by zippers, VELCRO, slots, and/or a track mechanism (not illustrated). Additionally, it is noted that the previously described inner unit should be utilized in conjunction with the shield 46 of FIG. 7 to enhance maneuverability and control.

Obviously, many modifications and variations of the present invention are possible in light of the above teachings.

For example, although a rigid inner unit has been described, it is within the purview of the present invention to utilize an inflatable bladder as an inner unit. The bladder can include a manual valve for optimal pressure adjustment for a user's individual buoyancy characteristics. It is therefore to be understood that, within the scope of the appended claims, the invention may be practiced otherwise than as specifically described.

What is claimed and desired to be secured by Letters Patent of the United States is:

1. An apparatus for body surfing comprising:

a garment for covering at least a portion of the torso of the user during use;

an outer shell securely attached to a torso portion of said garment, said outer shell being located adjacent the torso of the user during use thereof for providing hydro-dynamic lift for the user while traveling with the forward motion of the wave, the inner surface of the outer shell being contoured to conform substantially to a user's torso; and, directional control and stabilization means including at least one longitudinally directed fin attached directly to said garment for controlled maneuverability for the user while traveling with the forward motion of the wave.

2. The apparatus of claim 1 wherein said outer shell is contoured to substantially conform to a user's rib cage.

3. The apparatus of claim 2 wherein said outer shell is unitary and has a substantially smooth central portion and a flared smooth edge portion to conform with the natural curvature of the user's torso.

4. The apparatus of claim 3 wherein said flared edge portion is located along side sections and a leading section of said outer shell.

5. The apparatus of claim 2 wherein said outer shell is formed of closed cell polyurethane foam.

6. The apparatus of claim 2 wherein said outer shell is formed of high density polyethylene.

7. The apparatus of claim 2 wherein said outer shell is formed of a rigid material.

8. The apparatus of claim 1 wherein said garment includes a neoprene wetsuit.

9. The apparatus of claim 6 wherein said outer shell is attached to said garment by an epoxy resin.

10. The apparatus of claim 1 including a plurality of longitudinally directed fins.

11. The apparatus of claim 1 wherein said garment includes leg portions for covering at least a portion of the upper legs of the user during use, said plurality of longitudinally directed fins being attached to said leg portions.

12. The apparatus of claim 11 wherein each of said fins has an aft surface being contoured substantially to the shape of the user's thighs.

13. An apparatus for body surfing, comprising:

a garment for covering at least a portion of the torso of the user during use; and, an outer shell securely attached to a torso portion of said garment, said outer shell including, (a) a shield portion having an inner surface bonded to an outer surface of the torso portion of said garment, the inner surface of shield being contoured to substantially conform to a user's upper torso; and, (b) directional control and stabilization means including at least one longitudinally directed fin connected to said shield portion for controlled maneuverability for the user while traveling with the forward motion of the wave, and, at least one longitudinally directed fin attached to aid garment for enhancing maneuverability.

14. The apparatus of claim 13, wherein said shield portion includes a central section and two symmetrically disposed lateral sections, each lateral section having a longitudinally disposed, integrally attached fin thereon.

15. The apparatus of claim 13, wherein said outer shell is formed of semi-flexible closed cell polyurethane foam to provide sufficient flexibility for user maneuverability and to enhance buoyancy.

16. The apparatus of claim 15 wherein said garment includes leg portions for covering at least a portion of the upper legs of the user during use, a longitudinally directed fin being attached to each of said leg portions.

17. An apparatus for body surfing, comprising:

(a) a garment for covering at least a portion of the torso of the user during use;

(b) an outer shell securely attached to a torso portion of said garment, said outer shell being located adjacent the torso of the user during use thereof for providing hydro-dynamic lift for the user while traveling with the forward motion of the wave; and, (c) an inner unit locatable adjacent an inner surface of said garment, said inner unit being located between said garment and at least a portion of the user's torso during use, said inner unit providing increased protection for the user and being formed of a buoyant material for added lift during use.

18. An apparatus for body surfing, comprising:

(a) a garment for covering at least a portion of the torso of the user during use;

(b) an outer shell securely attached to an outer torso surface of said garment, said outer shell being located adjacent the torso of the user during use thereof for providing hydro-dynamic lift for the user while traveling with the forward motion of a wave; and (c) a removable inner unit locatable adjacent an inner surface of said garment, said inner unit being located between said garment and at least a portion of the user's torso during use, said inner unit providing increased protection for the user and added lift during use.

19. The apparatus of claim 18 wherein said inner unit comprises:

(a) a rigid inner element; and (b) a porous outer jacket secured about the periphery of said rigid inner element, a portion of said outer jacket being locatable adjacent the inner surface of said garment during use, said inner element and outer jacket being contoured to conform to the shape of a portion of said outer shell.

20. The apparatus of claim 19 wherein said rigid inner element is formed of epoxy resin.

21. The apparatus of claim 19 wherein said outer shell is formed of closed cell neoprene.

22. The apparatus of claim 19 wherein said outer jacket includes:

an anterior section having a surface locatable adjacent the inner surface of said garment during use; and a posterior section having a surface locatable adjacent the anterior of the torso of the user during use.

23. The apparatus of claim 22 wherein said anterior section is formed of high density closed cell neoprene.

24. The apparatus of claim 22 wherein said posterior section is formed of low density closed cell neoprene.

25. An apparatus for body surfing, comprising:

(a) a garment for covering at least a portion of the torso of the user during use;

(b) a rigid outer shell securely attached to a torso portion of said garment, said outer shell being located adjacent the torso of the user during use thereof for providing hydro-dynamic lift for the user while traveling with the forward motion of a wave; and (c) an inner unit rigidly secured to an inner surface of said garment, said inner unit being located between said garment and at least a portion of the user's torso during use, said inner unit providing increased protection for the user and added lift during use.

26. The apparatus of claim 25 wherein said rigid outer shell and inner unit are each contoured to substantially conform to a user's rib cage.

27. The apparatus of claim 26 wherein said garment includes a neoprene wetsuit.

28. The apparatus of claim 27 wherein said inner unit comprises:

(a) a rigid inner element; and (b) a porous outer jacket secured about the periphery of said rigid inner element.

29. The apparatus of claim 28 wherein said rigid inner element is formed of epoxy resin, and said outer jacket is formed of closed cell neoprene.

30. An apparatus for body surfing, comprising:

(a) a neoprene wetsuit for covering at least a portion of the torso of the user during use;

(b) a substantially smooth rigid outer shell securely attached to a torso portion of an outer surface of said neoprene wetsuit, said outer shell being located adjacent said torso of the user during use thereof for providing hydro-dynamic lift for the user while traveling with the forward motion of a wave; and (c) a rigid inner unit locatable adjacent an inner surface of said neoprene wetsuit, said inner unit being located between said neoprene wetsuit and at least a portion of the user's torso during use, said inner unit providing increased protection for the user and added lift during use.

31. An apparatus for body surfing, comprising:

(a) a neoprene wetsuit for covering at least a portion of the torso of the user during use;

(b) a substantially smooth rigid outer shell securely attached to a torso portion of an outer surface of said neoprene wetsuit, said outer shell being located adjacent said torso of the user during use thereof for providing hydro-dynamic lift for the user while traveling with the forward motion of a wave; and (c) a removable rigid inner unit locatable adjacent an inner surface of said neoprene wetsuit, said inner unit being located between said neoprene wetsuit and at least a portion of the user's torso during use, said inner unit providing increased protection for the user and added lift during use, said inner unit including, (i) a rigid inner element formed of epoxy resin;

(ii) a posterior section securely attached to a posterior surface of said rigid inner element, said posterior section having a posterior surface locatable adjacent the torso of the user during use, said posterior section being formed of low density close cell neoprene; and (iii)an anterior section being formed of high density closed cell neoprene being securely attached to an anterior surface of said rigid inner element, said anterior section including a posterior portion being attached to said rigid inner element and an anterior portion being securely attached to an anterior surface of said posterior portion, said anterior portion being shaped to mate in a complementary manner with the substantially smooth rigid outer shell during use thereof.

* * * * *

UNITED STATES PATENT AND TRADEMARK OFFICE

CERTIFICATE OF CORRECTION

PATENT NO. : 5,106,331

DATED : April 21, 1992

INVENTOR(S) : Lizarazu

It is certified that error appears in the above—identified patent and that said Letters Patent is hereby corrected as shown below:

On the title page, "Inventor:" should read:

-- [76] Inventors: Jairo Lizarazu, 2445 Porter St., Altadena, Calif. 91104; Richard E. Schumacher, Jr., 1242 19th St., Hermosa Beach, CA. 90254--

Signed and Sealed this

Twenty-second Day of June, 1993

*Attest:*

Michael K. Kirk

MICHAEL K. KIRK

*Attesting Officer*

*Acting Commissioner of Patents and Trademarks*